US011458380B2

(12) United States Patent
Canfield et al.

(10) Patent No.: US 11,458,380 B2
(45) Date of Patent: Oct. 4, 2022

(54) RETRACTABLE GAFF GUARD

(71) Applicant: Buckingham Manufacturing Company, Inc., Binghamton, NY (US)

(72) Inventors: Deforest C. Canfield, Oxford, NY (US); Timothy R. Batty, Binghamton, NY (US)

(73) Assignee: Buckingham Manufacturing Company, Inc., Binghamton, NY (US)

( * ) Notice: Subject to any disclaimer, the term of this patent is extended or adjusted under 35 U.S.C. 154(b) by 517 days.

(21) Appl. No.: 16/599,362

(22) Filed: Oct. 11, 2019

(65) Prior Publication Data

US 2020/0114239 A1 Apr. 16, 2020

Related U.S. Application Data

(60) Provisional application No. 62/744,349, filed on Oct. 11, 2018.

(51) Int. Cl.
*A63B 27/02* (2006.01)
*A63B 71/00* (2006.01)

(52) U.S. Cl.
CPC ..... *A63B 71/0054* (2013.01); *A63B 27/02* (2013.01); *A63B 2071/009* (2013.01)

(58) Field of Classification Search
CPC ..... A63B 27/02; A63B 71/0054; A63B 2071/009; A63B 2209/08; A63B 2209/10; A63B 2210/58
See application file for complete search history.

(56) References Cited

U.S. PATENT DOCUMENTS

| | | | | |
|---|---|---|---|---|
| 3,640,358 | A * | 2/1972 | Smith | A63B 27/02 182/221 |
| 4,282,951 | A * | 8/1981 | Zelins | A63B 27/02 182/221 |
| 4,989,693 | A * | 2/1991 | Williams | A63B 27/02 182/221 |
| 5,080,194 | A * | 1/1992 | Williams | A63B 27/02 182/221 |
| 9,770,625 | B1 * | 9/2017 | LaFore | A63B 27/00 |
| 9,821,192 | B2 | 11/2017 | Rullo et al. | |

* cited by examiner

*Primary Examiner* — Joshua Lee
(74) *Attorney, Agent, or Firm* — Bond, Schoeneck & King, PLLC; Frederick Price; George McGuire

(57) ABSTRACT

A retractable gaff guard which can be attached to a climber for use in protecting the gaff of a climber. A small retractable reel attached to a gaff guard via a cord woundable in an out of a housing of the reel that can attach on the outside of the leg iron of a climber. The cord is moveable between a retracted position and an extended position. Attached to the cord is a protective body that has a cavity which is dimensioned to receive a gaff of a climber.

10 Claims, 21 Drawing Sheets

RETRACTABLE GAFF GUARD

CROSS REFERENCE TO RELATED APPLICATIONS

This application claims priority to U.S. Provisional Patent Application Ser. No. 62/744,349 filed on Oct. 11, 2018, entitled Retractable Gaff Guard, which is incorporated herein by reference in its entirety.

FIELD OF THE INVENTION

The present invention relates generally to a gaff guard/cover for a gaff used on a climber, and particularly to a retractable gaff guard/cover.

BACKGROUND OF THE INVENTION

Climbers are used by arborists, utility lineman, and others having a need to climb trees or poles. A typical climber includes a stirrup in which the user places his/her foot, a leg iron that extends upwardly from the stirrup and is intended to be positioned on the inside of the user's leg, a climber pad that attaches to the top of the leg iron and straps the climber to the user's leg while affording some padding, and a gaff that extends downwardly from the exterior of the leg iron and is used by the user to bite into the tree or pole and provide support while climbing. The gaff may be permanently affixed to the leg iron or attached via a fastener system such that it can be replaced or reconditioned.

The gaff is an important tool when climbing as it provides the support the user needs while ascending and descending the tree or pole (see, e.g., U.S. Pat. No. 9,821,192). When the user is not actively ascending and descending the tree or pole the gaff should be covered. Covers for gaffs exist, however, such gaff covers may be cumbersome as they are not retractable. Gaff covers/guards that are not retractable can get in the way of a user of the climber and are not as secure. Accordingly, there is a need in the art for gaff covers/guards that are retractable.

Description of the Related Art Section Disclaimer: To the extent that specific patents/publications/products are discussed above in this Background Section or elsewhere in this Application, these discussions should not be taken as an admission that the discussed patents/publications/products are prior art for patent law purposes. For example, some or all of the discussed patents/publications/products may not be sufficiently early in time, may not reflect subject matter developed early enough in time and/or may not be sufficiently enabling so as to amount to prior art for patent law purposes. To the extent that specific patents/publications/products are discussed above in this Background Section and/or throughout the application, the descriptions/disclosures of which are all hereby incorporated by reference into this document in their respective entirety(ies).

BRIEF SUMMARY OF THE INVENTION

It is therefore a principal object and advantage of the present invention to provide a gaff guard/cover that eliminates one or more of the problems/issues discussed above. In particular, the present disclosure is directed to a retractable gaff guard device for a gaff, which can include a small retractable reel attached to a gaff guard via a cord, string, line, or other similar material (woundable in an out of a spool and/or housing) that can attach on the outside of the leg iron, pad, or strap of a climber. The retractable gaff guard device is configured to extend and retract line, which is attached to a gaff guard, in and out of the housing and to get the gaff guard out of the way and secured when not in use—which is much more convenient, safer (less likely to trip over or lose, or get caught on anything), as compared to conventional prior art devices.

BRIEF DESCRIPTION OF THE DRAWINGS

The embodied invention will be more fully understood and appreciated by reading the following detailed description in conjunction with the accompanying drawings, in which.

DETAILED DESCRIPTION OF EMBODIMENTS

Aspects of the present invention and certain features, advantages, and details thereof, are explained more fully below with reference to the non-limiting examples illustrated in the accompanying drawings. Descriptions of well-known structures are omitted so as not to unnecessarily obscure the invention in detail. It should be understood, however, that the detailed description and the specific example, while indicating aspects of the invention, are given by way of illustration only, and are not by way of limitation. Various substitutions, modifications, additions, and/or arrangements, within the spirit and/or scope of the underlying inventive concepts will be apparent to those skilled in the art from this disclosure.

Figure 1:
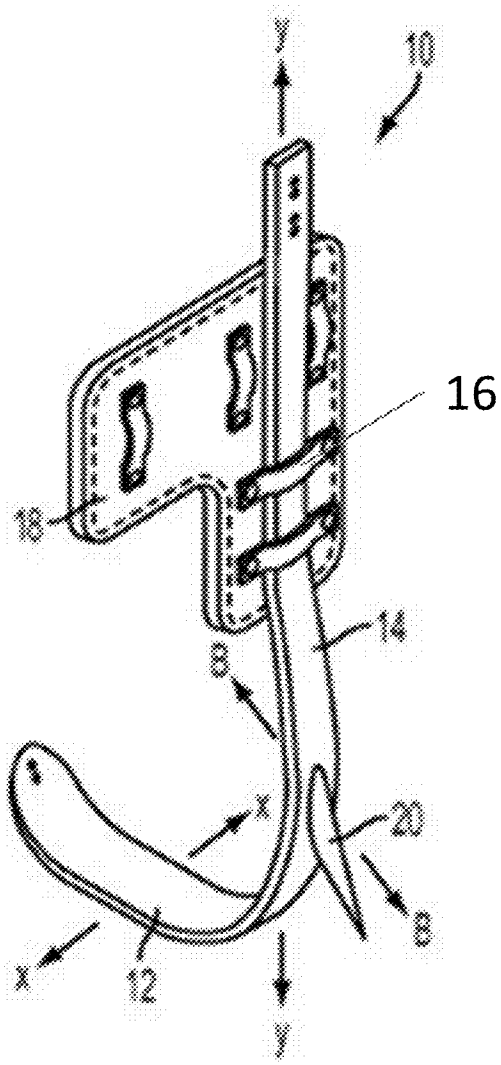
Fig. 1 (Prior Art)
FIG. 1 is a perspective view of a prior art climber.

Referring now to the drawings, wherein like reference numerals refer to like parts throughout, there is seen in the FIG. 1 an example of a climber, designated generally by reference numeral 10. Climber 10 comprises a stirrup portion/stirrup 12 that is adapted to receive a user's foot thereon, a leg iron 14 extending upwardly from stirrup 12, a strap 16 and climber pad 18 attached to the top of leg iron 14 and adapted to secure climber 10 to the user's leg, and a gaff 20 attached to the exterior surface of leg iron 14.

Figure 2:
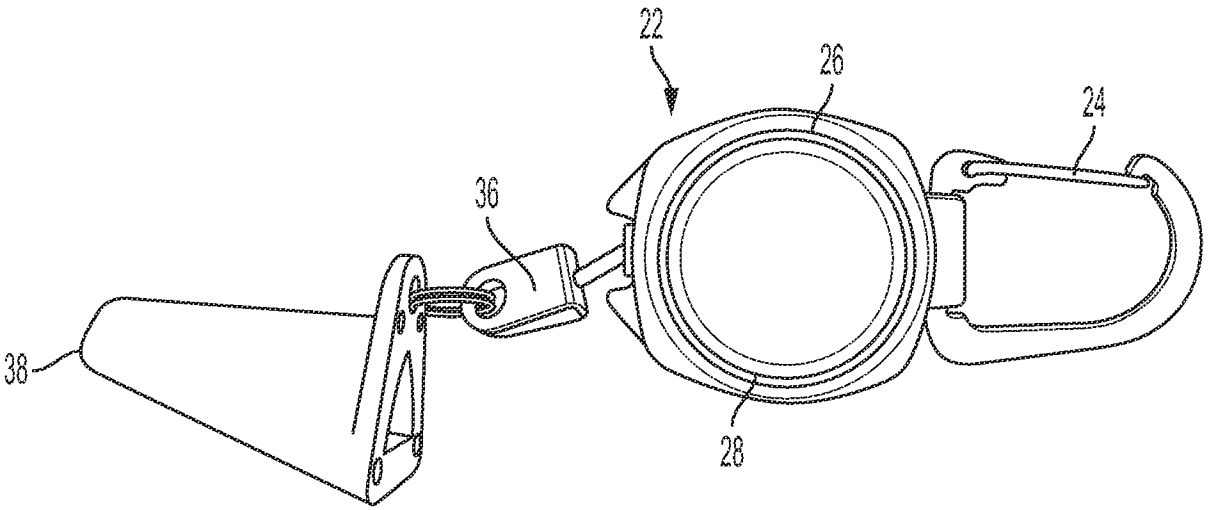
FIG. 2 is a perspective view of an example of a retractable gaff guard, according to an embodiment.

FIG. 2 depicts an example of a retractable gaff guard in a retracted position designated generally by reference numeral 22. Retractable gaff guard 22 comprises a connector 24, a reel 26 comprised of a housing 28, a spool (not shown), and a biasing member (e.g., a spring, not shown), a spooled cord 34 (not shown in this view), a coupler 36 which is attached to the cord 34 and a protective body 38. In this example, the connector 24 is a metal carabiner with a spring-loaded gate. However, the connector 24 can be implemented by any suitable connector known in the art. In this example the reel 26 is a reel with a rounded molded plastic housing 28, however, the reel 26 can be implemented by any suitable retractable device known in the art (as should be understood by a person or ordinary skill in the art in conjunction with a review of this disclosure). In this example, the coupler 36 is a metal clip, however, the coupler 36 can be implemented by any suitable coupler 36 known in the art such as but not limited to a ring or a carabiner.

Figure 3:
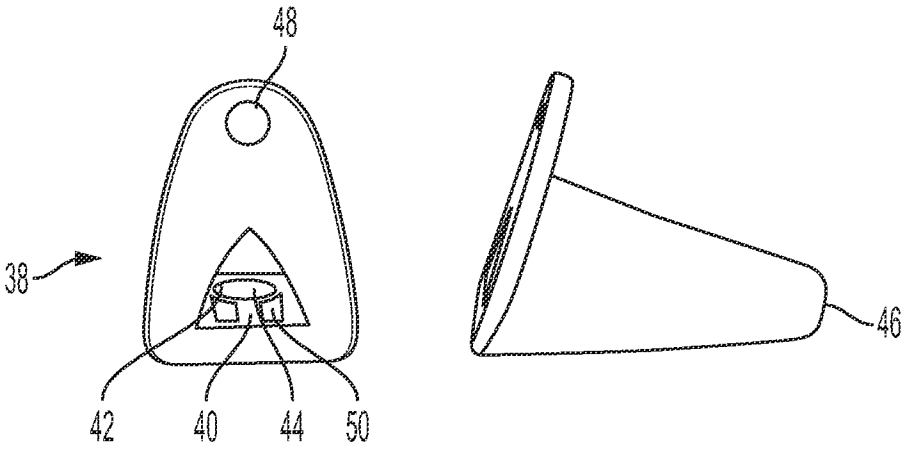
FIG. 3 is a bottom and side view of an example of a protective body, according to an embodiment.

Referring now to FIG. 3, there is shown an example of the protective body 38 which is generally conically shaped and has an interior wall 40 that defines a tapered cavity 42 having one open end 44 and one closed end 46 (the protective body 38 does not have to be such a shape, and can be any shape sufficient to cover the blade portion of the gaff to protect a user therefrom). The bottom of the protective body 38 has a protruding flat edge/surface with a circular hole 48 for attachment to coupler 36. The tapered cavity 42 has an open end 44 which is dimensioned to receive gaff 20 and can be triangular shaped as seen here or any other suitable shape for receiving gaff 20. In this example, the interior wall 40 of the protective body 38 encloses a magnet 50. Magnet 50 grasps the protective body 38 to stay more securely in place when placed on the gaff 20. By having the protective body 38 attached to the coupler 36 can be easily switched out by disconnecting the coupler 36 and attaching a new protective body 38.

Figure 4:
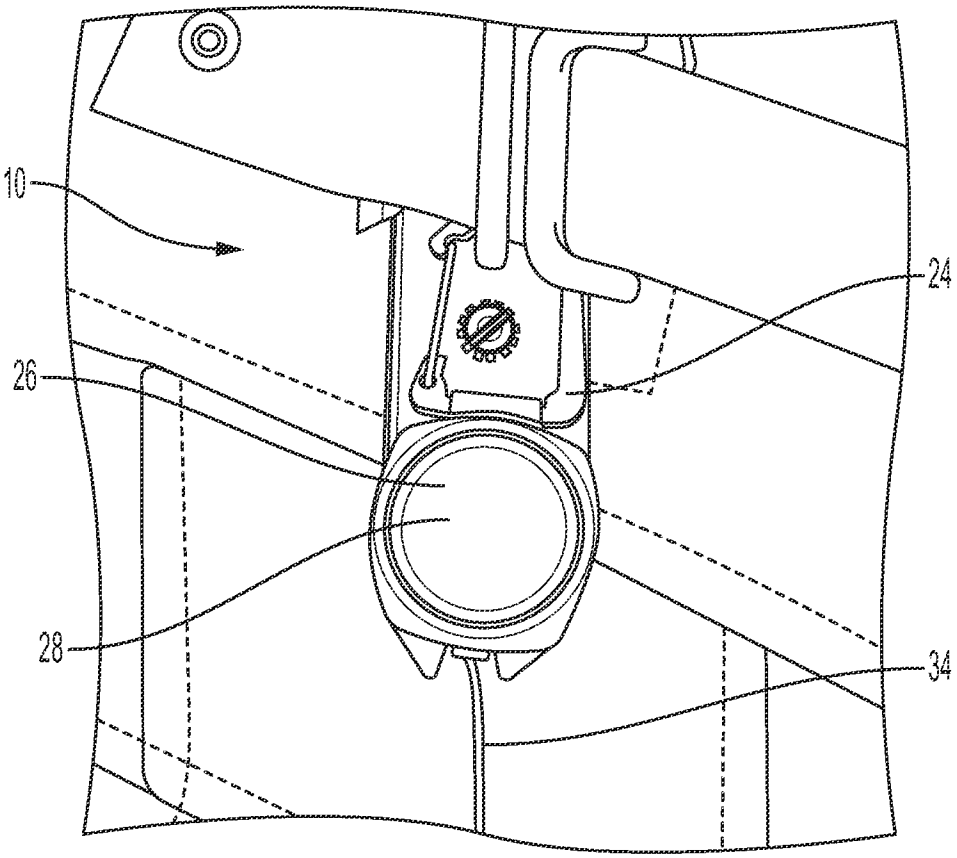
FIG. 4 is an enlarged perspective view of an example of a reel of a retractable gaff guard in a retracted position attached to a climber, according to an embodiment.
Figure 10:
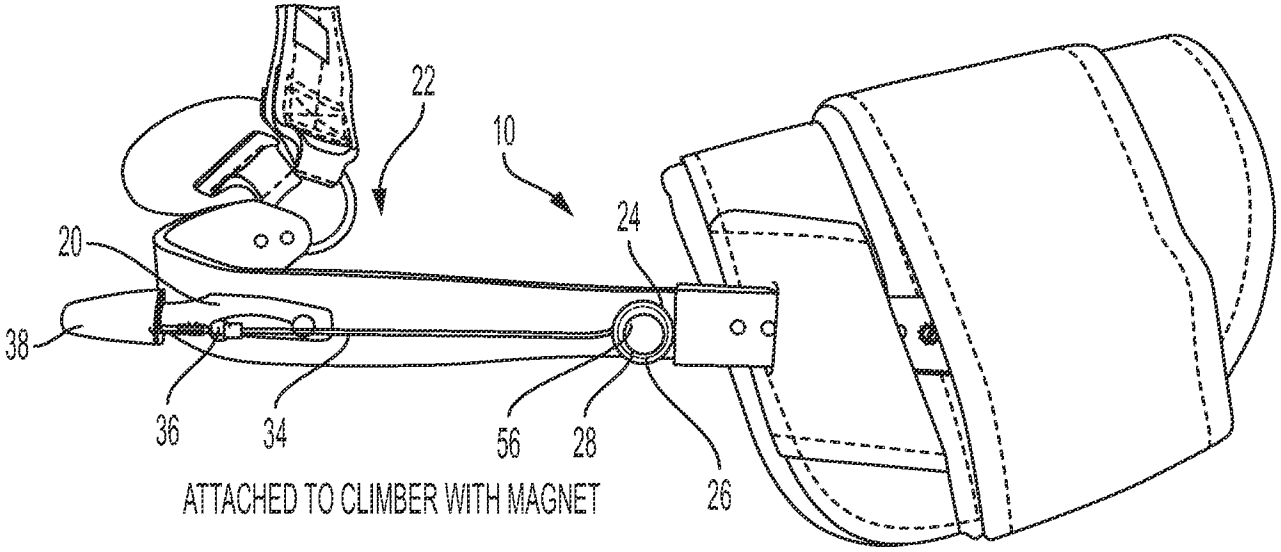
FIG. 10 is a perspective view of an alternate example of a retractable gaff guard in an engaged position on a climber, according to an embodiment.
Figure 11:
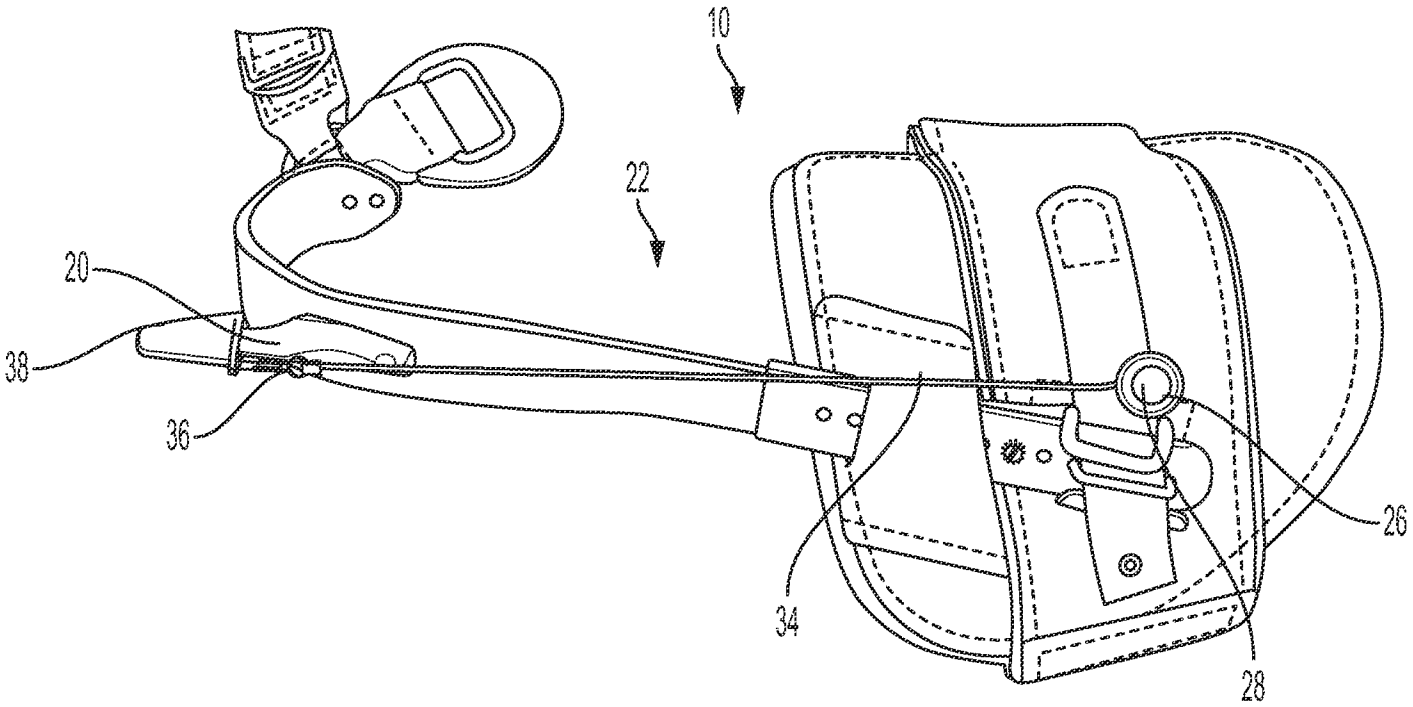
FIG. 11 is a perspective view of an alternate example of a retractable gaff guard in an engaged position on a climber, according to an embodiment.
Figure 12:
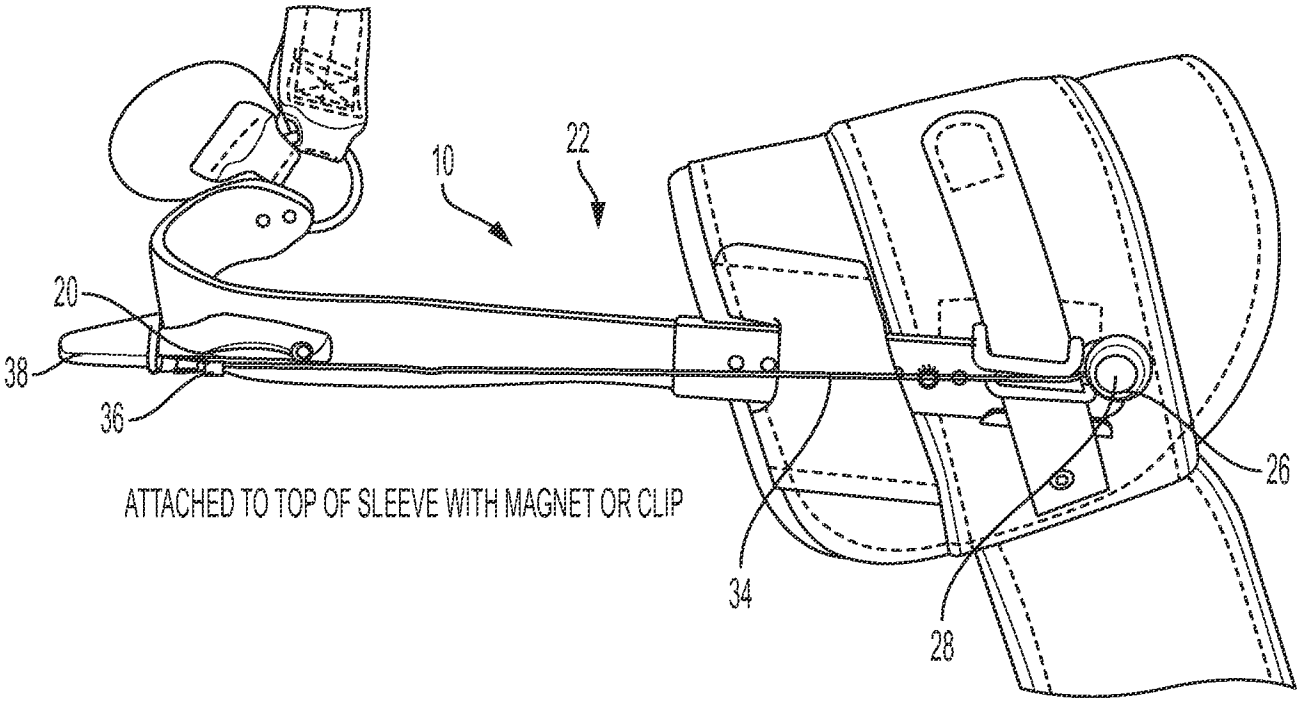
FIG. 12 is a perspective view of an alternate example of a retractable gaff guard in an engaged position on a climber, according to an embodiment.

FIG. 4 depicts an example of the connector 24 being used to secure the retractable gaff guard 22 to the climber 10. It is to be understood the climber 10 illustrated in FIG. 1 is one of several commercially available climbers 10, and the use of the retractable gaff guard 22 of an embodiment is not limited to use on that specific climber 10. In use, a user will attach the retractable gaff guard 22 to a climber 10 by using the connector 24. In some prior art, guards could be easily lost, forgotten, or could fall off the gaff 20. The connector 24 solves this problem by allowing the retractable gaff guard 22 to be attached directly to the climber 10. The connector 24 can be attached to any portion of the climber 10 that is above the gaff 20 along they axis. In this example the connector 24 is attached to the strap 16 of the climber 10. Examples of other locations that the connector 24 may be placed are illustrated in FIGS. 10, 11, and 12 described below.

Figure 5:
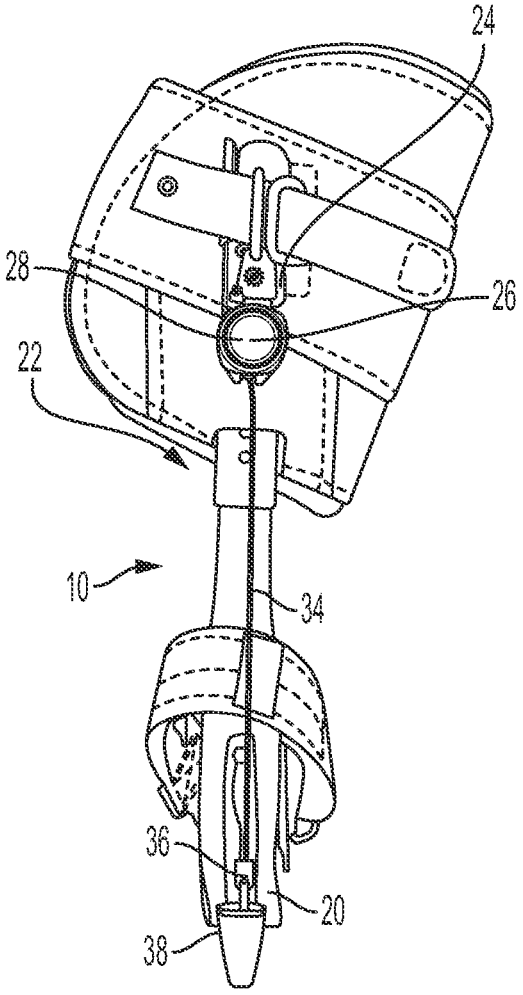
FIG. 5 is a perspective view of an example of a retractable gaff guard in an engaged position attached to a climber, according to an embodiment.

Referring now to FIG. 5, there is shown an example of the retractable gaff guard 22 in the extended position. When the user wants the gaff 20 to be protected such as seen in FIG. 5, the distal end of the cord 34 can be pulled out of the reel 26 and moved into an extended position so that the protective body 38 can be in a position to receive the gaff 20. In this example the cord 34 is vinyl coated steel wire, however, the cord 34 can be implemented by any suitable cordage known the art such as but not limited to string, rope, or chain. As such, cord 34 can be made of any material such as but not limited to vinyl, metal, leather, or fabric. The cord 34 is of a suitable length so that the connector 24 can be placed on top of the climber 10 and the cord 34 can be extended to a position below the gaff 20. The protective body 38 and the distal end of the cord 34 can extended to be at any distance away from the gaff 20 up to the maximum length of the cord 34.

Figure 6:
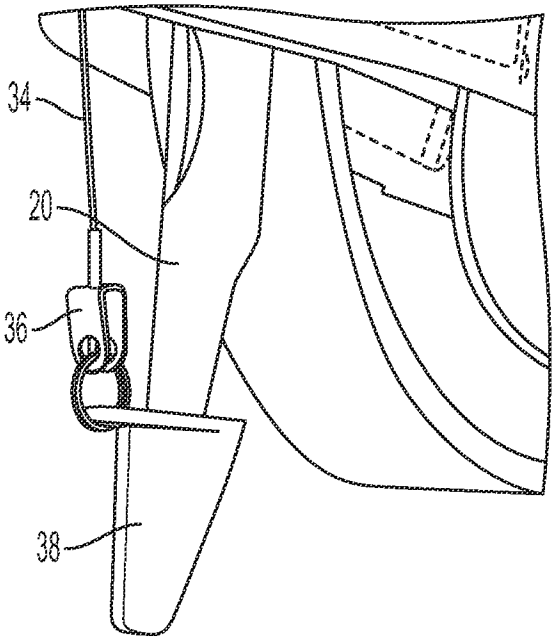
FIG. 6 is an enlarged perspective view of an example of a retractable gaff guard in an engaged position attached to a climber, according to an embodiment.

Referring now to FIG. 6, when gaff 20 is placed into the tapered cavity 42 the cord 34 can be retracted back into the reel 26 until is tight and the protective body 38 is secure. The retractable gaff guard 22 can be used to protect the user from being injured by the gaff 20, to protect the gaff 20 from hitting other objects and becoming dull, and to protect others and objects from injuries or damage when the gaff 20 it is not being used to climb.

Figure 7:
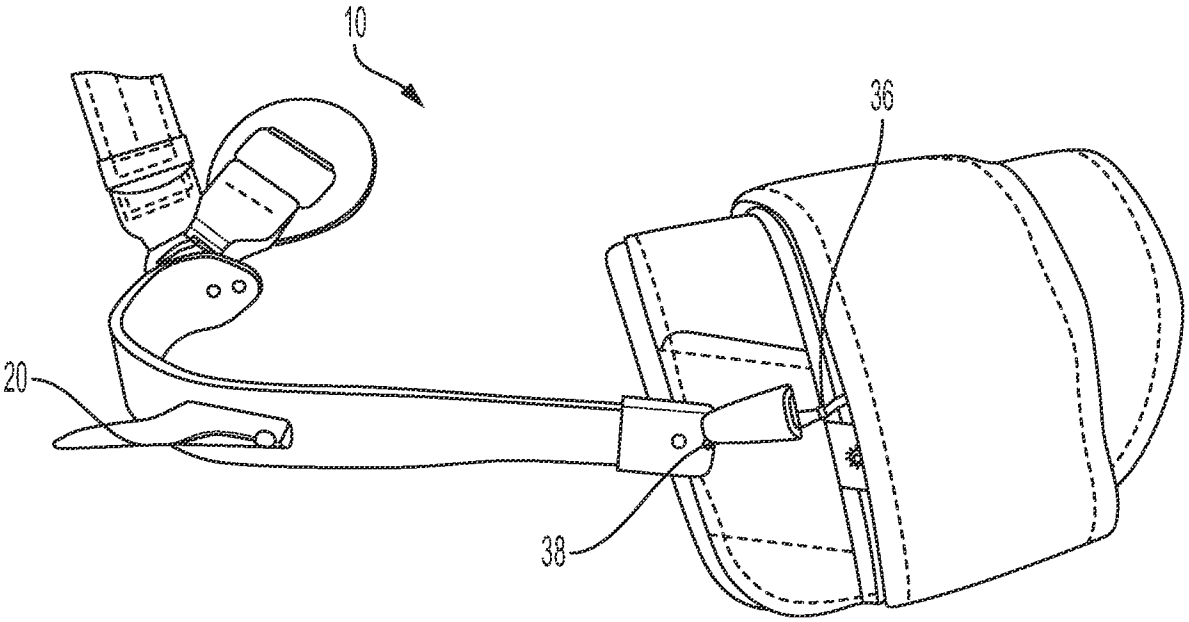
FIG. 7 is a perspective view of an example of a retractable gaff guard in a retracted position attached to a climber, according to an embodiment.

Referring to FIG. 7, when the user wants to have the gaff 20 exposed, the reel 26 can be used to retract the cord 34 into the housing 28. The proximal end of the cord 34 remains intact with the reel 26. When the reel 26 is used, the spring 32 or other biasing/actuating mechanism will pull back the cord 34 around the spool 30 within the housing 28 after the protective body is removed from covering the gaff 20. This will place the cord 34 in a retracted position and the distal end of the cord 34 and the protective body 38 will be in close proximity to the reel 26. In the retracted position the protective body 38 is not in contact with the gaff 20.

When a user is ready to climb, he or she can kick the protective body 38 off of the gaff 20 (or otherwise remove the protective body 38 from the gaff 20) and retractable gaff guard 22 will automatically retract up smoothly and easily. When the user wants the gaff 20 to be exposed, such as seen in FIG. 7, the cord 34 can be retracted back into the housing 28 when not in use by a spring 32 or other biasing or actuation mechanism (as should be appreciated by a person of skill in the art in conjunction with a review of this disclosure). The ability of the reel 26 to retract allows the protective body 38 to be able to be in placed in a location close to the reel 26 so that the protective body 38 will not be freely and loosely dangling, as it does in some conventional devices.

Figure 8:
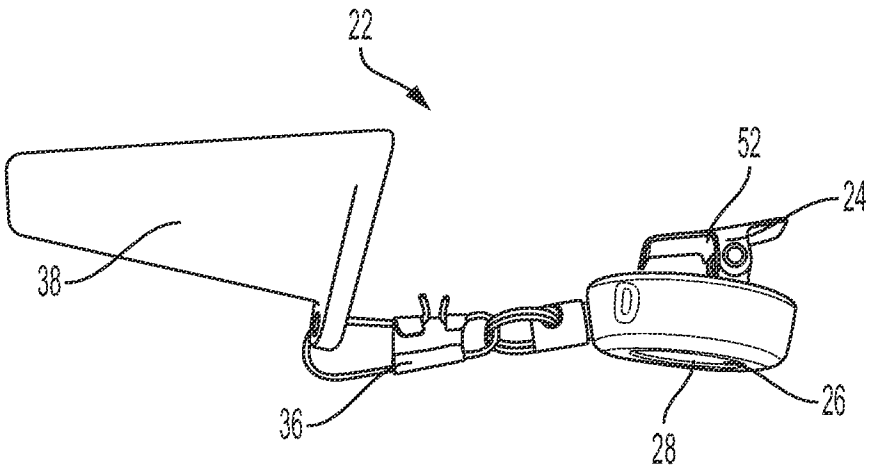
FIG. 8 is a perspective view of an alternate example of a retractable gaff guard, according to an embodiment.
Figure 9:
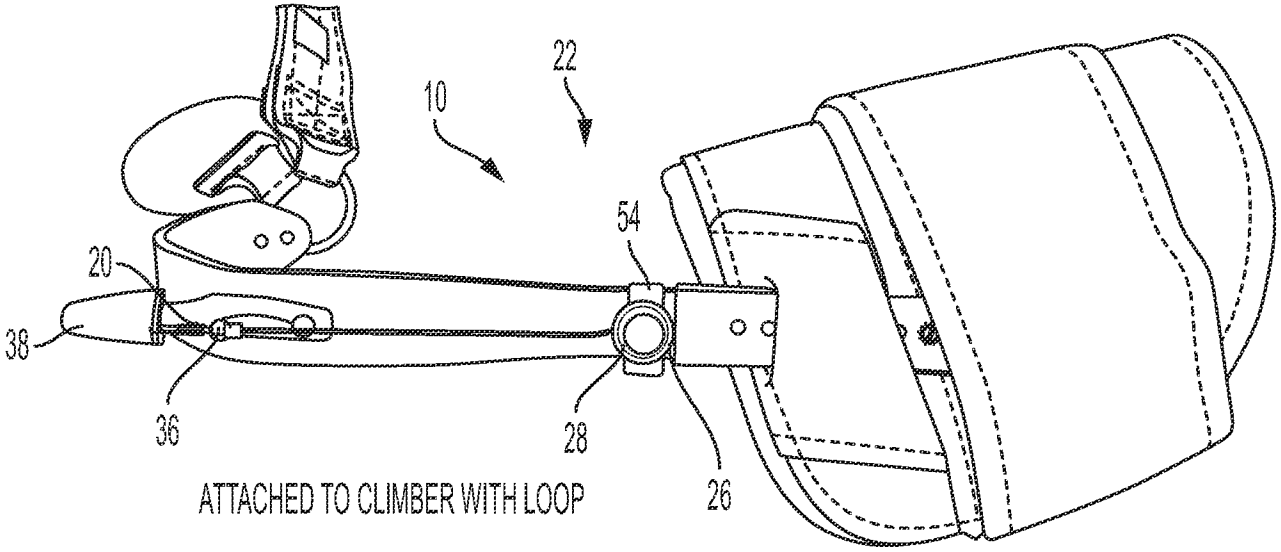
FIG. 9 is a perspective view of an alternate example of a retractable gaff guard in an engaged position on a climber, according to an embodiment.

In FIGS. 8, 9, and 10 there are shown alternative examples of connectors 24. As mentioned, attachment to the climber 10 can be accomplished by any suitable apparatus with the same or similar attachment functionality (as should be understood by a person of skill in the art in conjunction with a review of this disclosure). FIG. 8 depicts the use of a metal clip 52 as a connector 24 which can be connected to any portion of the climber 10 that can be grasped by the clip 52. FIG. 9 depicts the use of a fabric loop 54 as a connector 24 which can be connected around the leg iron 14. FIG. 10 depicts the use of a magnet 56 as a connector 24 which can be connected to any metal portion of the climber 10.

Attachment to the climber 10 can be at any position above the gaff 20 on the climber 10 on the y-axis (or at a position that otherwise positioned in a direction opposite to the direction of the point of the gaff 20, e.g., if the gaff point were positioned in a one direction along the horizontal axis, the attachment to the climber can be in the opposite direction along the horizontal axis). Examples of different positions that the retractable gaff guard 22 can be placed are depicted in FIGS. 10, 11, and 12. FIG. 10 depicts the retractable gaff guard 22 attached to the upper portion of the leg iron 14 by a magnet 56, however connector 24 can be attached to the leg iron 14 at any distance above the gaff 20. FIG. 11 depicts the retractable gaff guard 22 attached to the strap 16. FIG. 12 depicts the retractable gaff guard 22 attached to the climber pad 18. The retractable gaff guard 22 can be attached to any suitable portion of the strap 16 or pad 18.

Figure 13:
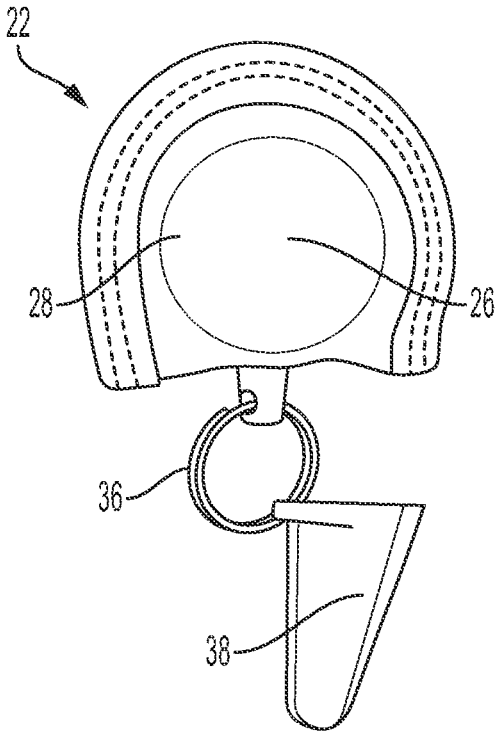
FIG. 13 is a perspective view of an alternate example of a retractable gaff guard, according to an embodiment.
Figure 14:
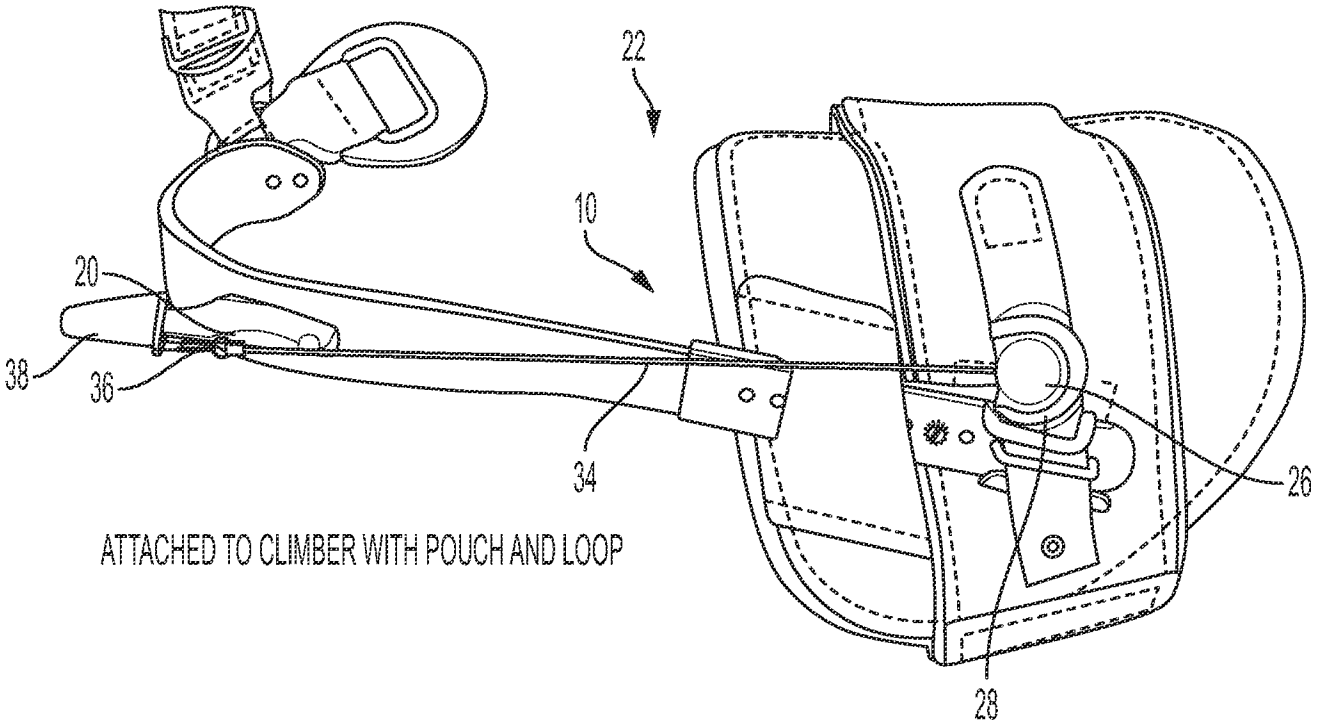
FIG. 14 is a perspective view of an alternate example of a retractable gaff guard in an engaged position on a climber, according to an embodiment.
Figure 15:
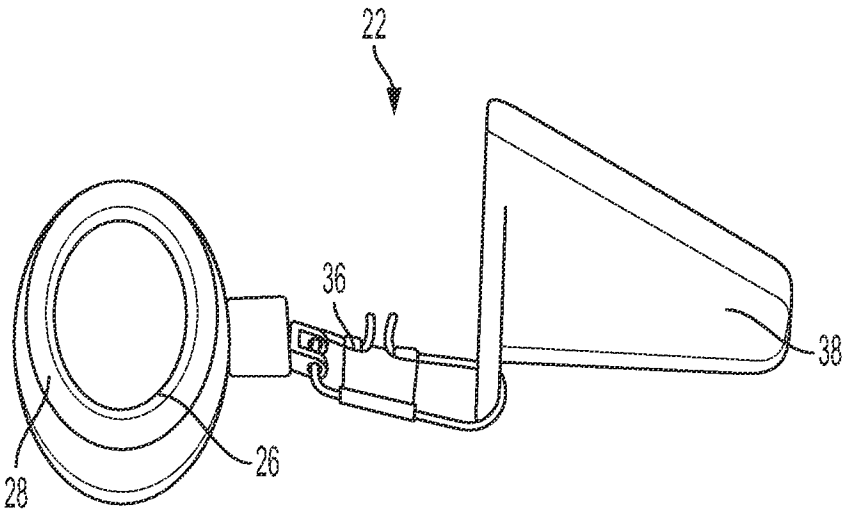
FIG. 15 is a perspective view of an alternate example of a retractable gaff guard, according to an embodiment.
Figure 16:
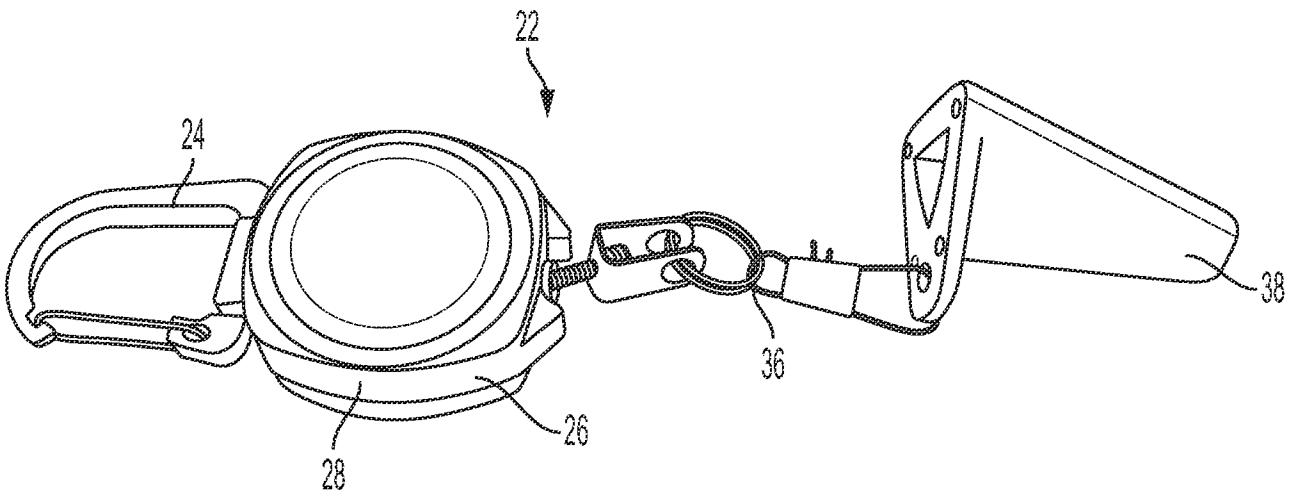
FIG. 16 is a perspective view of an alternate example of a retractable gaff guard, according to an embodiment.
Figure 17:
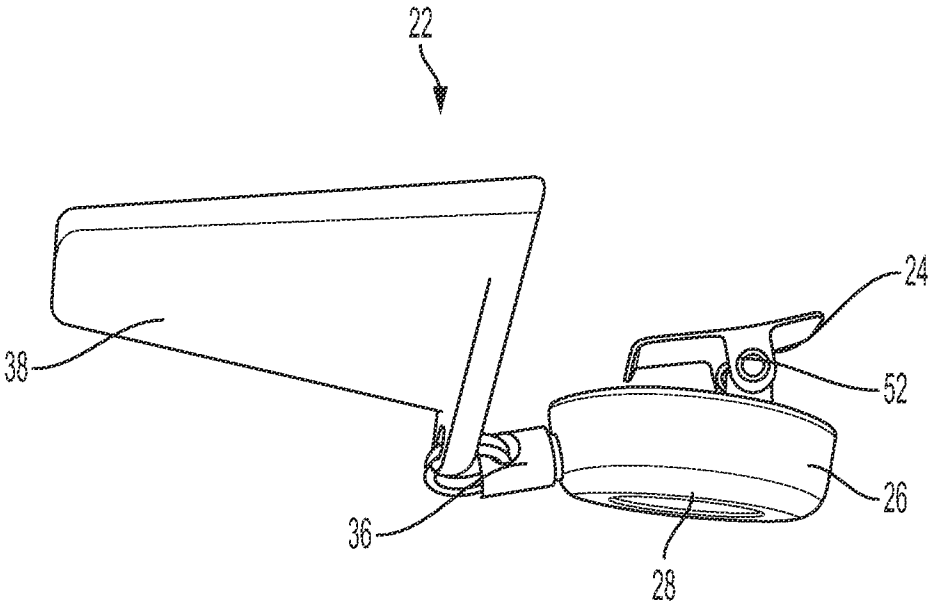
FIG. 17 is an enlarged perspective view of an alternate example of a retractable gaff guard, according to an embodiment.

In FIGS. 12, 13, and 15, there are shown alternative examples of a reel 26. FIGS. 12 and 15 depict an example of the reel 26 having a small rounded metal housing 28. While FIGS. 13 and 14 shows an example of the reel 26 being comprised of a leather or fabric housing 28. The housing 28 seen here is semi-circular and the fabric is fastened on the edges with stitching; however, this could be accomplished by any other means such as but not limited to glue, fasteners, or staples.

FIGS. 13, 15, 16, and 17 depict alternative examples of couplers 36 that may be used. Coupler 36 described herein can be described as mechanical connections. "Mechanically connected" can include both direct mechanical connections, and indirect mechanical connections made through intermediate components; includes rigid mechanical connections as well as mechanical connection that allows for relative motion between the mechanically connected components; includes, but is not limited, to welded connections, solder connections, connections by fasteners (for example, nails, bolts, screws, nuts, hook-and-loop fasteners, knots, rivets, quick-release connections, latches and/or magnetic connections), force fit connections, friction fit connections, connections secured by engagement caused by gravitational forces, pivoting or rotatable connections, and/or slidable mechanical connections. For example, a ring as shown in FIG. 13 can be used so that the protective body 38 can be easily exchanged or replaced as may be needed.

Figure 18:
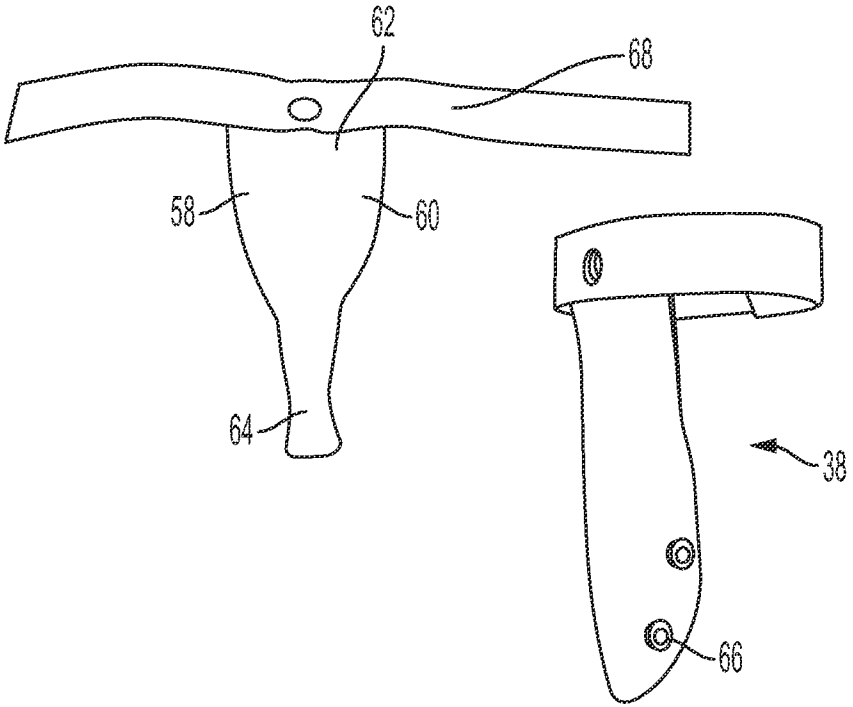
FIG. 18 is a top and side view of an example of a protective body, according to an embodiment.
Figure 19:
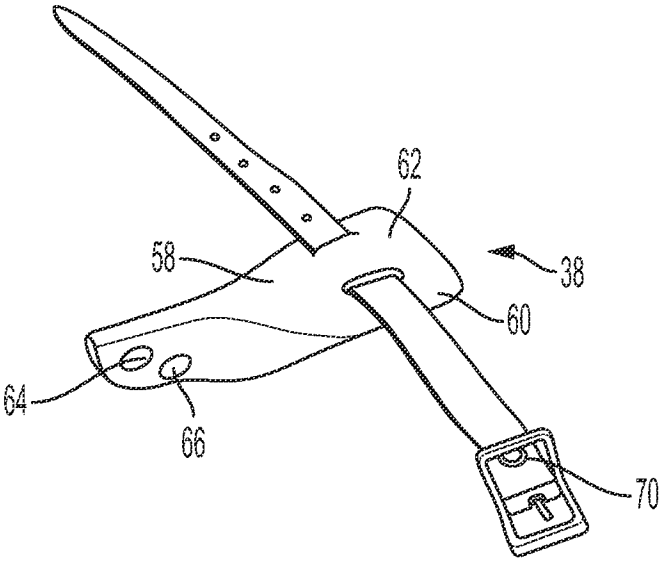
FIG. 19 is a perspective view of an example of a protective body, according to an embodiment.
Figure 20:
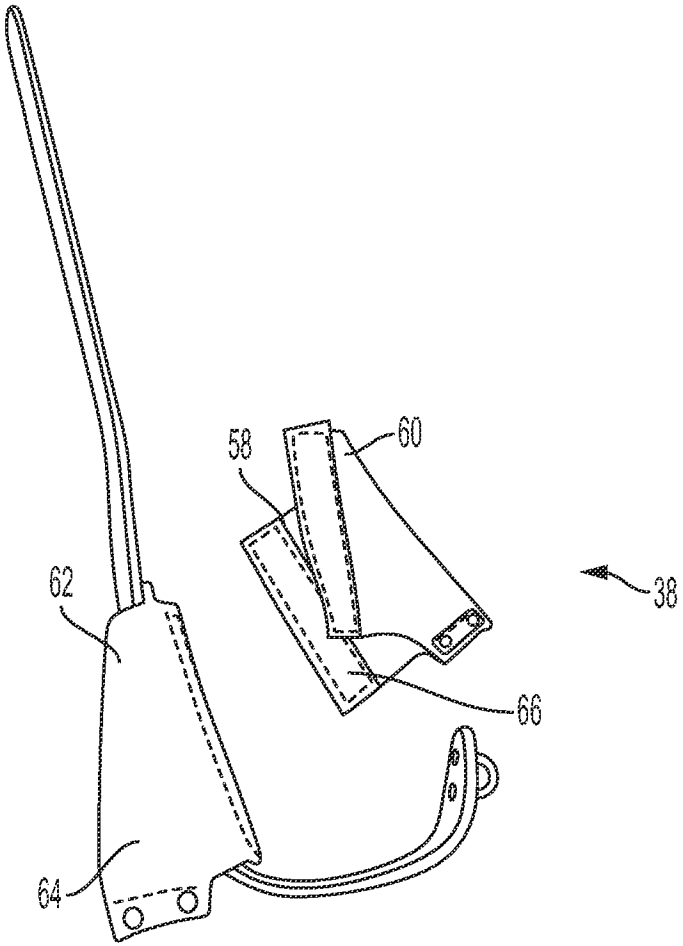
FIG. 20 is a perspective view of an example of a protective body and a side perspective view of an example of a protective body on a climber, according to an embodiment.

FIGS. 18, 19, and 20 show alternative examples of protective bodies 38 that may be used. In these examples, the protective body 38 has a first side 58, a second side 60, a top 62 and a bottom 64. At least a non-complete portion of the first side 58 can be secured to at least a non-complete portion of the second side 60 to form a tapered cavity having an open end and a closed end. This cavity is dimensioned to allow the gaff 20 to be received. The securing of the first side 58 and the second side 60 can be done with any suitable fasteners 66, such as but not limited to stitches, staples, glue, hook and loop, or fasteners.

In FIG. 18 there is shown a protective body 38, with a top 62 and a bottom 64 and the first side 58 and the second side 60 secured with fasteners 66. This example also depicts a belt 68 attached to the top 62 to secure to the leg iron 14 of the climber 10. The belt 68 allows for can also be equipped with hook and loop fasteners. FIG. 19 depicts a protective body 38 with the first side 58 and the second side 60 secured with steel rivets to prevent gaff 20 tip from protruding out from bottom 64 and there is a belt 68 with a buckle 70 around the top 62. FIG. 20 depicts a protective body 38 wherein the first side 58 is secured to the second side 60 by hook and loop fasteners 66 and there are steel rivets to prevent the gaff 20 from protruding out the bottom.

Figure 21:
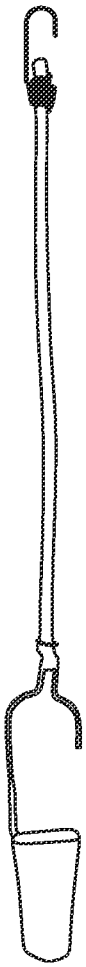
FIG. 21 PRIOR ART
FIG. 21 is a perspective view of a prior art gaff guard device.

Referring now to FIG. 21, there is shown a prior art example of a gaff guard. This gaff guard is a bungee cord with a hook connector on one end for attachment to a climber 10 and a protective body on the other end for covering a gaff 20. However, this prior art example has limited functionality. There is no reel in which the cord can wrap its self around and fully retract, and therefore when the protective body is not engaged around the gaff 20 the cord will hang freely. When the cord hangs freely the cord can get wrapped around items causing them to be broken or causing the cord to pull on the climber 10 (creating potential safety hazards for a user).

Although the present invention has been described in connection with a preferred example, it should be understood that modifications, alterations, and additions can be made to the invention without departing from the scope of the invention as defined by the claims.

All definitions, as defined and used herein, should be understood to control over dictionary definitions, definitions in documents incorporated by reference, and/or ordinary meanings of the defined terms.

While various embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as, "has" and "having"), "include" (and any form of include, such as "includes" and "including"), and "contain" (any form of contain, such as "contains" and "containing") are open-ended linking verbs. As a result, a method or device that "comprises", "has", "includes" or "contains" one or more steps or elements. Likewise, a step of method or an element of a device that "comprises", "has", "includes" or "contains" one or more features possesses those one or more features, but is not limited to possessing only those one or more features. Furthermore, a device or structure that is configured in a certain way is configured in at least that way, but may also be configured in ways that are not listed.

The corresponding structures, materials, acts and equivalents of all means or step plus function elements in the claims below, if any, are intended to include any structure, material or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of one or more aspects of the invention and the practical application, and to enable others of ordinary skill in the art to understand one or more aspects of the present invention for various embodiments with various modifications as are suited to the particular use contemplated.

What is claimed is:

1. A retractable gaff guard, comprising:

a reel comprising a housing having an interior space and including a spool and a biasing member positioned inside the housing, wherein the biasing member is configured to exert a force on the spool to spin the spool in one direction;

a cord having a proximal end and a distal end, wherein the proximal end is secured to the reel and the cord is moveable between a retracted position and an extended position wherein when in the extended position the distal end of the cord is at a distance further away from the reel than when in the retracted position, wherein the force exerted by the biasing member on the spool is configured to withdraw the cord into the retracted position from the extended position, when not acted upon by an equal or greater force in the opposite direction, such that the cord is wound around the spool when the cord is in the retracted position; and a protective body connected to the distal end of the cord wherein the protective body has an interior wall defining a cavity having an open end and a closed end, wherein the cavity is characterized by being dimensioned to receive a gaff.

2. The retractable gaff guard of claim 1, wherein the protective body is conical shaped with a bottom, wherein the bottom contains the open end of the cavity.

3. The retractable gaff guard of claim 2, wherein the bottom of the protective body has a protruding edge with a circular hole defined therein.

4. The retractable gaff guard of claim 3, wherein the open end of the cavity is triangularly shaped.

5. The retractable gaff guard of claim 4, wherein the interior wall of the protective body comprises a magnet.

6. The retractable gaff guard of claim 1, further comprising a connector secured to the reel.

7. The retractable gaff guard of claim 6, wherein the connector is a clip.

8. The retractable gaff guard of claim 6, wherein the connector is a magnet.

9. The retractable gaff guard of claim 6, wherein the connector is a loop.

10. The retractable gaff guard of claim 1, further comprising a coupler that is mutually attached to the distal end of the cord and to the protective body.

* * * * *